US007062886B2

(12) United States Patent
Auriemma

(10) Patent No.: US 7,062,886 B2
(45) Date of Patent: Jun. 20, 2006

(54) HOLD DOWN CLIP

(75) Inventor: Joseph Auriemma, Jeffersonville, PA (US)

(73) Assignee: Worthington Armstrong Venture, Malvern, PA (US)

( * ) Notice: Subject to any disclaimer, the term of this patent is extended or adjusted under 35 U.S.C. 154(b) by 0 days.

(21) Appl. No.: 10/670,923

(22) Filed: Sep. 24, 2003

(65) Prior Publication Data

US 2005/0060850 A1 Mar. 24, 2005

(51) Int. Cl.
*E04B 9/26* (2006.01)

(52) U.S. Cl. ..... 52/506.7; 52/772; 52/773; 52/489.1; 24/547; 24/501; 248/316.5

(58) Field of Classification Search ..... 24/545–547, 24/563, 568, 30.5 P, 487, 495–497, 489, 24/501, 500; 52/506.08, 733.1, 750, 484, 52/506.7, 489, 489.1, 489.2, 769, 773; 248/316.5, 248/316.6, 316.7, 344, 500
See application file for complete search history.

(56) References Cited

U.S. PATENT DOCUMENTS

| | | | | |
|---|---|---|---|---|
| 1,793,127 | A | 2/1931 | Osius | |
| 2,172,302 | A * | 9/1939 | Tinnerman | 24/563 |
| 2,720,290 | A | 10/1955 | Henrickson | |
| 2,803,321 | A | 8/1957 | Fox-Williams | |
| 2,818,235 | A | 12/1957 | Baran | |
| 3,077,057 | A * | 2/1963 | Forkin | 52/506.08 |
| 3,137,901 | A | 6/1964 | Malachowski et al. | |
| 3,248,839 | A | 5/1966 | Roberts et al. | |
| 3,263,388 | A | 8/1966 | Bogert | |
| 3,565,473 | A | 2/1971 | Kedel | |
| 3,815,309 | A | 6/1974 | Olsen | |
| 3,834,106 | A | 9/1974 | Astedt et al. | |
| 4,027,454 | A | 6/1977 | Schuplin | |
| 4,033,079 | A | 7/1977 | Cross, Jr. | |
| 4,232,081 | A | 11/1980 | Pullan | |
| 4,580,382 | A | 4/1986 | Judkins et al. | |
| 4,580,387 | A * | 4/1986 | Rogers | 52/665 |
| 4,679,375 | A | 7/1987 | Shirey | |
| 4,775,121 | A * | 10/1988 | Carty | 248/68.1 |
| 4,827,681 | A | 5/1989 | Platt | |
| 4,858,408 | A | 8/1989 | Dunn | |
| 4,873,809 | A * | 10/1989 | Paul | 52/506.07 |
| 4,967,530 | A | 11/1990 | Clunn | |
| 4,991,373 | A | 2/1991 | Shaub | |
| 5,033,247 | A | 7/1991 | Clunn | |
| 5,174,065 | A | 12/1992 | Schlicht | |
| 5,253,463 | A | 10/1993 | Witmyer | |
| 5,603,193 | A | 2/1997 | Koertge et al. | |
| 5,611,185 | A | 3/1997 | Wilz | |
| 5,970,586 | A * | 10/1999 | Demel et al. | 24/563 |
| 6,018,850 | A * | 2/2000 | Lorber | 24/543 |
| D421,897 | S | 3/2000 | Washecheck et al. | |
| 6,298,526 | B1 * | 10/2001 | Baumdicker et al. | 24/563 |
| 6,725,508 | B1 * | 4/2004 | Noda et al. | 24/545 |

* cited by examiner

OTHER PUBLICATIONS

Armstrong Architects reference for ceiling systems and acoustical walls 2001- cover page, pp. 132 and 133, pp. 162 through 165 (total of 7 sheets), no date is given.

*Primary Examiner*—Jack W. Lavinder
(74) *Attorney, Agent, or Firm*—Eugene Chovanes

(57) ABSTRACT

A clip to hold panels in place in grid openings in a suspended ceiling. The clip is integrally formed and includes relatively flexible hinges that bias relatively rigid sections against the panels.

6 Claims, 3 Drawing Sheets

HOLD DOWN CLIP

BACKGROUND OF THE INVENTION

1. Field of the Invention

The invention relates to a suspended grid ceiling having panels in grid openings, and particularly to such ceilings where there is a special need to hold the panels down in place on the flanges of the beams forming the grid openings.

2. The Prior Art

Suspended ceilings used extensively in building construction have a grid of intersecting beams suspended by wires from a structural ceiling. The grid has rectangular openings formed by the intersecting beams, that receive laid in panels. Such a ceiling is shown in U.S. Pat. No. 4,827,681, for instance, incorporated herein by reference.

The beams are formed of a web of flat steel roll formed into an inverted T. The panels are supported on the flanges of the T, with the hanging wires anchored above in the structural ceiling, and connected below to holes in the web of the beam.

Generally, in suspended ceilings, the weight of a panel is enough to bias the panel downward and keep it in place in the grid opening.

There are many suspended ceiling installations, however, where it is desirable or necessary to hold a panel in place within a grid opening by retaining members, such as clips. For instance, in suspended ceilings in gymnasiums and and other large open areas, the ceiling is subjected to gusts of air or wind that may blow the panels out of place if retaining members are not used. Retaining members are also desirable, for instance, in suspended ceilings used in clean rooms, or other contained environments. Such a ceiling is shown in copending U.S. patent application Ser. No. 10/346,039, filed Jan. 16, 2003, for CEILING GRID WITH SEAL, incorporated herein by reference. In such ceilings, retaining members, such as hold down clips, keep the panels in close contact with the seals that exist between the panels and the grids, to avoid air movement through the ceiling.

Retaining members, such as hold down clips, are particularly necessary in a suspended ceiling in areas prone to seismic events, especially in public spaces such as auditoriums, to keep the panels from shaking loose and raining down, during an earthquake, upon a gathering seated below.

Hold down clips are also used in suspended ceilings where pressure is exerted on the panels from below, such as in places where it is necessary to hose down the ceiling with water, for sanitary purposes. The clips keep the panels anchored in place.

The prior art generally uses hold down clips, of the type shown, for instance, in U.S. Pat. Nos. 4,027,454 and 4,858,408, to secure the panels in the above cited installations.

The clips are usually of metal and are either of the spring type as shown in the '408 patent, or of a panel piercing type, with tabs to secure the clip to the beam, as shown in the '454 patent.

These prior cut clips vary in complexity, effectiveness, and ease of installation.

SUMMARY OF THE PRESENT INVENTION

The hold down clip of the present invention is of the resilient type, formed integrally of a dually extruded plastic such as PVC. The clip is easy to make, and easy to apply to the beams of the grid, to effectively hold down varying thicknesses of panels.

The clip has an upper inverted U shaped section that resiliently straddles the bulb portion of a grid beam, that is connected to a lower portion having a leg hinged to each of the depending arms of the inverted U. The upper inverted U section and legs are formed of a relatively rigid PVC plastic, with the connecting portion, in the form of a hinge which biases the legs downward, formed of a relatively flexible PVC plastic. A continuous length of clip is extruded in a prior art dual extrusion process, and then cut into clip segments.

The upper inverted U shaped section of a relatively rigid plastic is resilient enough to spread and snap over various size bulbs of a grid beam, while the more flexible PVC of the hinge portions acts to bias the legs of the more rigid plastic, downward, giving a spring effect.

The clip works with virtually any thickness panel, since the legs can flex over the varying thicknesses of the panel. The clip can be easily applied and removed.

DESCRIPTION OF THE PREFERRED EMBODIMENT

Figure 1:
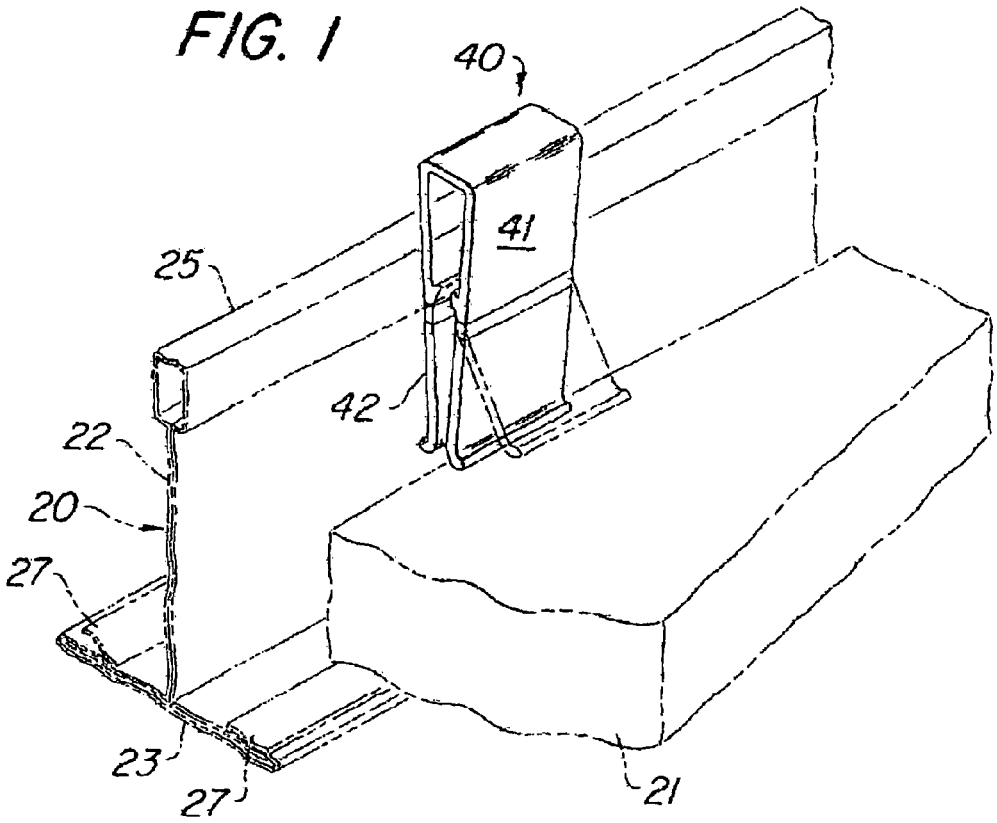
FIG. 1 is a perspective view of a clip attached to a clean room grid beam. The beam and panel are shown in phantom, as is a leg of the clip holding the panel down.

As seen particularly in FIG. 1, a grid beam 20 of the type shown in above referred to copending U.S. patent application Ser. No. 10/346,039 forms part of a grid that receives panels 21 to form a suspended ceiling. The grid is supported from a structural ceiling by wires. Such a ceiling is shown, for instance, in U.S. Pat. No. 4,827,681, referred to above, and is extensively used in building construction.

The beam 20 itself is of an inverted T shape with essentially a vertical web 22 and a horizontal flange 23. The web 22 has at the top some form of bulb 25, which provides a stiffener to the web 22. At the bottom of web 22, the flange 23 extends on each side of the web 22, to provide a support for a panel 21 which rest in a rectangular grid opening created by interlocking grid beams. Such construction is well known.

Figure 3:
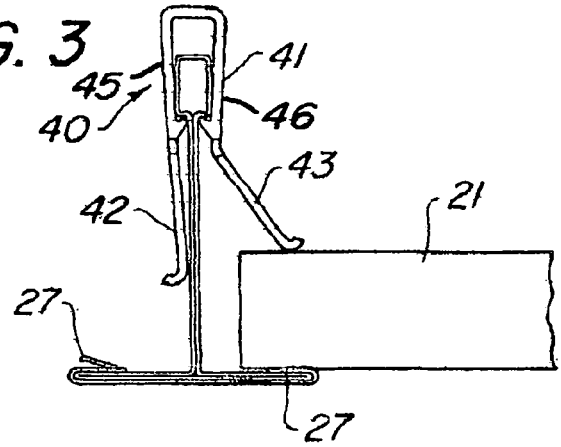
FIG. 3 is an end view of a clip attached to a grid beam with seals, holding down a panel.
Figure 4:
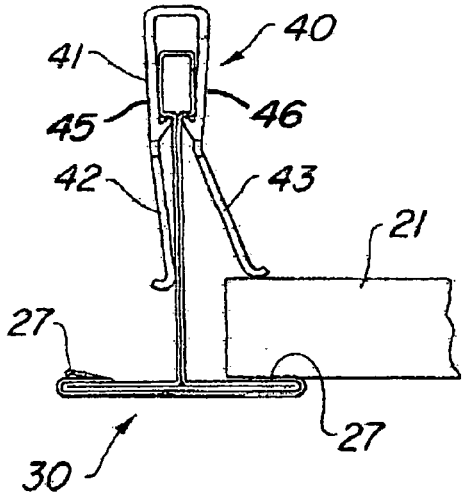
FIG. 4 is an end view, similar to FIG. 3, showing a thinner panel than that in FIG. 3, being held down by the clip of the invention.

In the grid beam depicted in FIGS. 1, 3, and 4, plastic flaps 27, biased upward, yield to provide seals between the panel 21 and the flange 23. Such a structure is shown in copending U.S. patent application Ser. No. 10/346,039 referred to above.

Figure 5:
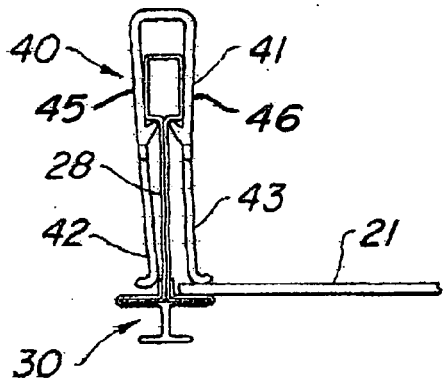
FIG. 5 is an end view of the clip of the invention secured to a grid beam having a decorative flange, showing the clip holding down a very thin panel.
Figure 6:
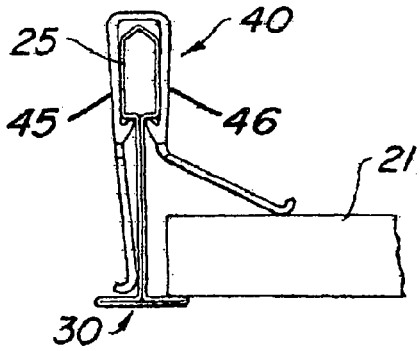
FIG. 6 is an end view of the clip of the invention secured to a grid beam having a web and bulb of an extended height.

In FIGS. 5 and 6 there is shown beams 28 and 30 of a more prevalent type, without such seals.

Examples of the beams 28 and 30 of FIGS. 5 and 6 are shown, for instance, in the above referred to U.S. Pat. No. 4,827,681.

The hold down clip 40 of the invention is capable of being used with a wide variety of beams, including those referred to above, and with different thickness panels.

Figure 2:
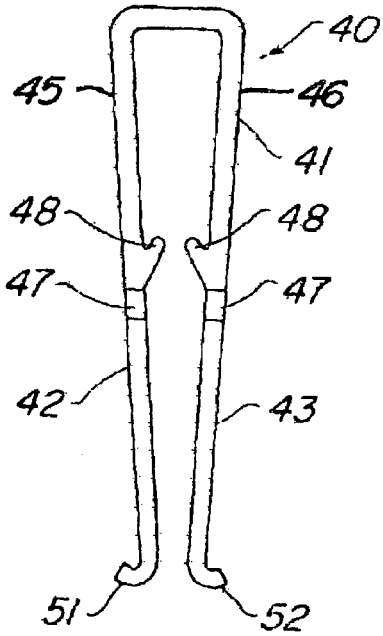
FIG. 2 is an end view, by itself, of the clip shown in FIG. 1.

The clip 40, as seen in FIGS. 1 and 2, for instance, has an upper inverted U section 41.

As seen particularly in FIGS. 1 and 2, the hold down clip 40 has an upper inverted U shaped section 41 and lower legs 42 and 43. Legs 42 and 43 are joined respectively to the depending arms 45 and 46 of the upper inverted U section 41 by plastic hinges 47. Hinges 47 are formed of a more flexible PVC plastic, than the relatively rigid PVC plastic that forms section 41, and legs 42. The entire clip 40 is dually extruded into lengths which are then suitably cut to the length of the clip. An inwardly and upwardly directed tab 48 is formed on the inside of arms 45 and 46 of section 41.

Curved portions 51 and 52 are formed at the bottom of legs 42 and 43 respectively.

The upper inverted U section 41 and legs 42 and 43 which are formed of the same relatively rigid PVC, while the hinges, which are formed of a relatively flexible PVC, are dually extruded at the same time.

Figure 2A:
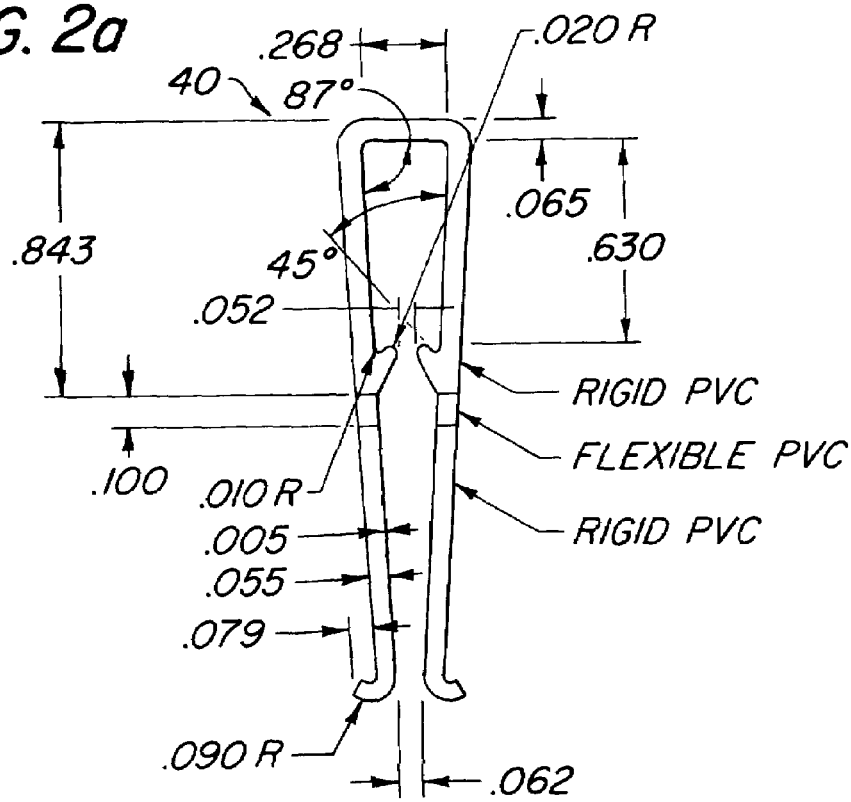
FIG. 2*a* is an end view of the clip of FIG. 1, with representative dimensions in inches.
Figure 2B:
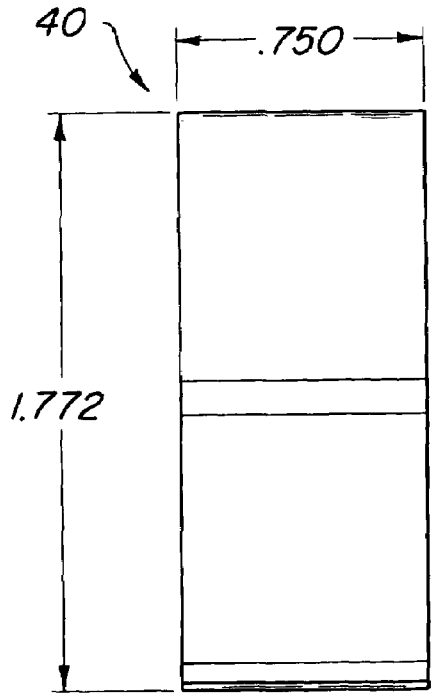
FIG. 2*b* is a side view of the clip of FIG. 1, with representative dimensions in inches.

There is shown in FIGS. 2*a* and 2*b* a clip of the invention with representative dimensions, in inches, of one embodiment.

The entire clip 40 with the parts set forth above, is formed by a dual extrusion process wherein extended lengths of the clip are continuously extruded and then cut into clip lengths, as, for instance, seen in FIG. 2*b*.

Representative prior art dual extrusion processes are set forth in U.S. Pat. Nos. 4,232,081 and 5,174,065, incorporated herein by reference.

The clip 40 is used in the manner shown in the drawings, and as further described herein.

Before the clip 40 is attached, a suspended ceiling grid is constructed in the usual prior art manner, wherein beams are interlocked to form the grid, and the grid is suspended by wires from a structural ceiling. Such a ceiling is shown in the above referred to U.S. Pat. No. 4,827,681. The panels 21 are laid into the grid openings in the usual way. After a panel 21 is laid in a grid opening, the installer reaches into the space above the ceiling from an adjacent opening, and applies the clip 40 by a downward movement onto the beam, in the manner that a forked wooden clothespin is attached to a clothesline. The clip 40 straddles the bulb 25 and web 22 of grid beam 20, and the upper inverted U section 41 spreads over the bulb 25. The clip 40 is forced downward until the tabs 48 pass over the bulb 25 and the arms 45 and 46 of the upper inverted U 41 snap back in against the web 22.

Meanwhile, the installer, while pushing down on the clip, lifts a leg 43, which is hinged at 47, and then permits it to rest on top of the panel 21. The bias of the hinge 47 exerts a downward force on the leg 43, which holds the panel 21 down.

When a panel 21 is placed in an opening adjacent a panel 21 that already has a clip 40 attached, the installer merely raises a leg of the installed clip to permit a panel to be put in place on the flanges of the grid opening, after which the leg is permitted, under the bias of the hinge 47, to bear against the panel being installed. In this manner, the clips are attached over the entire ceiling, whereby, in most instances, both of the legs 42 and 43 hold down a panel on each side of a grid beam, or at least one of the legs of a clip is engaged with a panel.

In the event it is necessary to remove a panel 21 or panels, to, for instance, gain access to the space above the suspended ceiling, it is merely necessary to exert firm upward force against the bottom of the panel 21, whereby the upper section of the clips holding the panel are simply forced apart, permitting the clip to slide up on the bulb of the beam, thus permitting the panel 21 to be manipulated upward, and if desired, then removed by manipulating the panel downward through the opening. After gaining an initial panel opening in the ceiling, the clips 40 on adjacent panels can be removed from above the suspended ceiling, and the panel held by the clips also removed.

FIGS. 3 through 6 show the versatility of the clip 40, whereby it can be used with varying sizes and shapes of beams 20, and varying thickness of panels 21. The bias of the hinge 47 causes a leg 42 or 43 to exert a downward force on the panel 21, whatever the thickness.

Curved positions 51 and 52 permit the legs 42 and 43 to apply the downward force in a firm manner without digging into the panel 21. This permits an ease of upward movement of the panel when it is desired to remove the panel, as described above, whereby the legs 43 or 44 slide on top of panel 21 without digging in to wedge the panel 21 in position.

As seen in the drawings, the clip 40 can be used on beams of varying web heights, and bulb shapes, with the upper section 41 accommodating such differences.

What is claimed is:

1. In combination with a panel resting on beams in a suspended ceiling; the improvement comprising a clip for holding the panels in place on the beams, the clip being integrally formed of synthetic resin and comprising relatively rigid upper inverted U section with downwardly extending arms, a relatively rigid leg depending from each of the arms of the upper inverted U section, and a relatively flexible downwardly biased hinge connecting each of the legs to each of the arms of the inverted section, whereby the downwardly biased hinges exert retaining forces, through the legs, against the panels, to hold the panels in place.

2. The combination of claim 1 wherein the clip is fabricated by a dual extrusion process.

3. The combination of claim 2 wherein the synthetic resin is polyvinyl chloride.

4. The combination of claim 1 wherein the upper inverted U section has tabs on the inside of the U for locking the clip to the bulb of a grid beam.

5. The combination of claim 1 wherein the upper inverted U section has rounded portion on the bottom of each leg.

6. The combination of claim 1, wherein the synthetic resin is extruded and then cut into segments to form the clip.

* * * * *

UNITED STATES PATENT AND TRADEMARK OFFICE

CERTIFICATE OF CORRECTION

PATENT NO. : 7,062,886 B2
APPLICATION NO. : 10/670923
DATED : June 20, 2006
INVENTOR(S) : Joseph Auriemma It is certified that error appears in the above-identified patent and that said Letters Patent is hereby corrected as shown below:

Column 4, line 39, after “comprising”, insert --a--.

Signed and Sealed this

Thirteenth Day of November, 2007

JON W. DUDAS
*Director of the United States Patent and Trademark Office*